US008561862B2

(12) United States Patent
Foggiato

(10) Patent No.: US 8,561,862 B2
(45) Date of Patent: Oct. 22, 2013

(54) PERSONAL SECURING APPARATUS FOR HANDHELD DEVICES

(76) Inventor: Jai Foggiato, Morgan Hill, CA (US)

( * ) Notice: Subject to any disclaimer, the term of this patent is extended or adjusted under 35 U.S.C. 154(b) by 1462 days.

(21) Appl. No.: 12/121,761

(22) Filed: May 15, 2008

(65) Prior Publication Data

US 2009/0283559 A1 Nov. 19, 2009

(51) Int. Cl.

| | |
|---|---|
| ***A45F 3/14*** | (2006.01) |
| ***A45F 5/00*** | (2006.01) |
| ***A45F 3/00*** | (2006.01) |

(52) U.S. Cl.

USPC ..... 224/217; 224/218; 224/267; 224/269; 224/255; 224/675

(58) Field of Classification Search

USPC ..... 224/217, 218, 267, 269, 930, 255, 675
See application file for complete search history.

(56) References Cited

U.S. PATENT DOCUMENTS

| | | | | | |
|---|---|---|---|---|---|
| 2,549,735 | A | * | 4/1951 | White et al. | 24/194 |
| 2,876,022 | A | * | 3/1959 | Kroviak | 108/43 |
| 3,116,947 | A | * | 1/1964 | Brownrigg | 294/31.2 |
| 4,117,573 | A | * | 10/1978 | Nakamura | 24/22 |
| 4,724,971 | A | * | 2/1988 | Henline | 215/396 |
| 4,984,724 | A | * | 1/1991 | Johnston | 224/257 |
| 5,135,455 | A | * | 8/1992 | King et al. | 482/108 |
| 5,155,659 | A | * | 10/1992 | Kunert | 361/679.56 |
| 5,183,169 | A | * | 2/1993 | Grzych | 215/395 |
| 5,307,966 | A | * | 5/1994 | Inaba et al. | 224/578 |
| D357,387 | S | * | 4/1995 | Davidson et al. | D7/622 |
| 5,433,359 | A | | 7/1995 | Flowers | |
| 5,575,555 | A | * | 11/1996 | Chang | 362/109 |
| 5,603,545 | A | | 2/1997 | Benson | |
| 5,680,977 | A | | 10/1997 | Burke | |
| 5,921,657 | A | * | 7/1999 | Case | 362/191 |
| 5,927,579 | A | | 7/1999 | Schwabe | |
| 5,957,515 | A | * | 9/1999 | Van Der Sluys | 294/25 |
| D422,500 | S | * | 4/2000 | Prevot | D9/434 |
| 6,117,526 | A | * | 9/2000 | Marks | 428/192 |
| 6,163,450 | A | * | 12/2000 | Kim | 361/679.27 |
| D458,800 | S | * | 6/2002 | Kotsonis | D7/393 |
| 6,550,108 | B2 | * | 4/2003 | Pratl | 24/3.13 |
| 6,595,703 | B1 | * | 7/2003 | Laituri et al. | 396/423 |
| 6,916,104 | B2 | * | 7/2005 | Parsons et al. | 362/191 |
| 6,919,104 | B2 | * | 7/2005 | Marzolin et al. | 427/385.5 |
| 6,991,829 | B2 | * | 1/2006 | Bergman | 427/429 |
| 7,023,692 | B2 | * | 4/2006 | Mansutti et al. | 361/679.56 |
| D522,752 | S | * | 6/2006 | Brown et al. | D3/316 |
| 7,458,921 | B2 | * | 12/2008 | Hallar | 482/106 |
| 7,469,809 | B2 | * | 12/2008 | Rodarte et al. | 224/578 |

(Continued)

*Primary Examiner* — Nathan J Newhouse
*Assistant Examiner* — Lester L Vanterpool
(74) *Attorney, Agent, or Firm* — Intellectual Property Law Group LLP

(57) ABSTRACT

A securing apparatus for a handheld device or object is comprised of a sleek, fashionable, flexible elastic strip or band, enhancing a user's gripping capability, thereby preventing abuse and accidental dropping of the device. The elastic strip is removably attached to the device by removable attaching means connected or integrated to each end of the strip. The apparatus may be further provided with a discrete lift mechanism, either attached or integrally formed with the elastic strip. The apparatus retains its form after stretching, and is taut against a surface of the device to avoid catching against exterior objects, fitting discretely on any surface of the device. The securing apparatus can be installed for easy use and minimal dexterity for all users and can be made in different sizes, color, and of different materials having elastomeric properties.

5 Claims, 3 Drawing Sheets

(56) References Cited

U.S. PATENT DOCUMENTS

| | | | | |
|---|---|---|---|---|
| 7,780,047 | B2 * | 8/2010 | Chen et al. | 224/218 |
| 2003/0066856 | A1 * | 4/2003 | Lehtonen | 224/675 |
| 2003/0148861 | A1 * | 8/2003 | McBride | 482/92 |
| 2004/0029623 | A1 | 2/2004 | Ellis et al. | |
| 2005/0205623 | A1 | 9/2005 | Buntain | |
| 2005/0272489 | A1 | 12/2005 | Lee | |
| 2005/0274755 | A1 | 12/2005 | Lee et al. | |
| 2006/0049579 | A1 | 3/2006 | Miyamoto | |
| 2006/0076375 | A1 | 4/2006 | Bhakta | |
| 2006/0076381 | A1 | 4/2006 | Elizalde Rodarte et al. | |
| 2006/0213940 | A1 | 9/2006 | Chen et al. | |
| 2008/0083797 | A1 * | 4/2008 | Myers | 224/217 |
| 2011/0309117 | A1 * | 12/2011 | Roberts | 224/217 |

* cited by examiner

PERSONAL SECURING APPARATUS FOR HANDHELD DEVICES

BACKGROUND OF THE INVENTION

1. Field of the Invention

Aspects of the invention generally relate to an accessory for retaining handheld devices and providing protection to such devices; and more particularly there is provided a sleek and fashionable yet strong securing apparatus that can be removably attached to a handheld device.

2. Background

Electronic and mechanical device malfunctions and repairs due to customer abuse and accidental drops are estimated to attribute to an estimated 10% to 15% of repairs, many of which are not captured or diagnosed in repair. There is an incentive for device manufacturers and sellers to curtail abuse and mishandling as it can result in saving millions of dollars in repair costs. Conventional methods for protecting handheld devices include encasing them in bulky cases or attaching to them unattractive and dangling lanyards making it difficult and burdensome in use. These products also only serve to protect the cosmetics of the device, but not the parts contained inside a device, generally containing sensitive components, solder joints bonding these components, or mechanically retained parts. As such, there is a need for a sleek and fashionable attachment that allows the user to readily hold handheld devices to prevent dropping, to reduce or eliminate abuse, in addition to eliminate the purchase of expensive and bulky accessories and attachments.

There are existing products such as a retainer consisting of a flexible sheet of material adhered to the surface of an electronic device by means of an adhesive film. Such a retainer comprises a number of slots allowing the user to slip his finger through the slot, thereby retaining the device on the user's fingers or hand. However, the structure of such a retainer having slots in the sheet consumes a large portion of the surface area of the device and requires unnecessary dexterity of the user to place fingers through the slots. Accordingly, there is still a need for a discrete solution that is removable, and can be applied on minimal surface area of a device, and requiring minimal effort of engagement by the user.

Other existing products also include a carrying structure that requires extensive prefabrication of slots manufactured into the device itself for engaging with a strap where one end has a snap module. Other products include lanyards and loops affixed to the device. However, such products are again bulky and irremovable as the holes are prefabricated into the device itself, making such a product impractical to integrate with existing devices. Dangling lanyards and other straps are further impractical, easily tangling and do not provide for a sleek and streamlined look.

Accordingly, there is a need for an inexpensive securing apparatus which can be attached to existing devices with minimal interference to any surface area of the device, non-bulky, lightweight, removable, and efficiently and easily engaging by a user by requiring minimal dexterity.

SUMMARY OF THE INVENTION

An object of the present invention is to provide a strong, sleek, fashionable, flexible and removable securing apparatus to facilitate the user of handheld devices or objects in gripping, carrying and using such devices or objects without dropping. The description with regard to devices throughout this document is also applicable to objects. This apparatus relates to a sleek and removable elastic strip or band that maintains form after stretching and lays substantially flush or in a taut state against any surface of the device. The apparatus can be attached to handheld devices on any surface and would rest tautly, close to the unit to avoid catching or interfering with objects such as pockets and handbags. The apparatus is attachable to any surface of the device and provide a single opening to engage, thus can be used ambidextrously by users. The apparatus allows the user to hold the handheld devices without dropping, and discourages the user from purchasing expensive and bulky cases. The apparatus further provides an alternative for users who do not normally use cases but would enjoy the added protection. The apparatus is inexpensive to make, inexpensive for consumers to replace, and can be available in multiple colors and styles.

To achieve these objectives, one of the embodiments of the invention comprises a securing apparatus having a strong, flexible, elastic strip comprising a removable attachment means on each end of the strip, for instance, adhesive ends which are attachable to the device. In an alternate embodiment, the attachment means comprise two small anchors to hold the strip in place and are attached to the device by a fastening means. Each anchor comprises two parts, where one part of each anchor is attached to the device with a removable fastening means and hence can be removed and cleaned without cosmetically affecting the device. The other part is attached to each end of the strip.

Other embodiments of the present invention comprise a strong, flexible, elastic strip having anchors which include discrete semi-permanent snaps or small buckle connections at each end of the strip for attaching the strip to the device. One side of each snap or buckle connection is attached to the device with removable adhesive and hence can be removed and cleaned without cosmetically affecting the unit. The corresponding other side of each snap or buckle connection is connected with an end of the strip to securely but removably engage with the side attached to the device.

An alternate embodiment of the present invention consists of a strong, flexible, elastic strip with two small hook and loop fastener (VELCRO®) pieces at each end of the strip. An engaging VELCRO® piece is attached to the device with removable adhesive or glue.

In another embodiment of the invention the securing apparatus comprises a strong and elastic strip provided with a thin lift mechanism which serves to assist in lifting the strip. The lift mechanism may be integrated or formed as part of the elastic strip or made removably attachable or adjustable in position along the elastic strip. The lift mechanism allows the user to engage one or more fingers between the strip and the device easily.

In alternate embodiments of the present invention the elastic strip is provided with a lift mechanism, having some curvature on one or more edges to further facilitate a user engaging the strip to lift it. The lift mechanism may be a harder piece of material than the material of the elastic strip or constructed of a similar elastic material maintaining a structure to facilitate lifting the strip. The entire securing apparatus is sleek, fashionable and discrete to fit on any surface of the device and has a width no larger than the smallest width of the device.

An object of the present invention to provide for a securing apparatus that minimally interferes with handling the device and other exterior objects, that is removably interchangeable, and thereby attractive, inexpensive and easy to apply. It is an object of the present invention that the securing apparatus provides minimal interference with objects during storage, for example handbags, purses, clothing pockets and the like.

It is an object of the present invention that the securing apparatus negligibly adds to the external dimensions of a device.

These and other embodiments of the present invention are further made apparent, in the remainder of the present document, to those of ordinary skill in the art.

BRIEF DESCRIPTION OF THE DRAWINGS

In order to more fully describe embodiments of the present invention, reference is made to the accompanying drawings. These drawings are not to be considered limitations on the scope of the invention, but are merely illustrative.

DETAILED DESCRIPTION OF SPECIFIC EMBODIMENTS

The description above and below and the drawings of the present document focus on one or more embodiments of the present invention and also describe some exemplary optional features and/or alternative embodiments. The description and drawings are for the purpose of illustration and not limitation. Those of ordinary skill in the art would recognize variations, modifications, and alternatives. Such variations, modifications, and alternatives are also within the scope of the present invention. Section titles are terse and are for convenience only.

Figure 1:
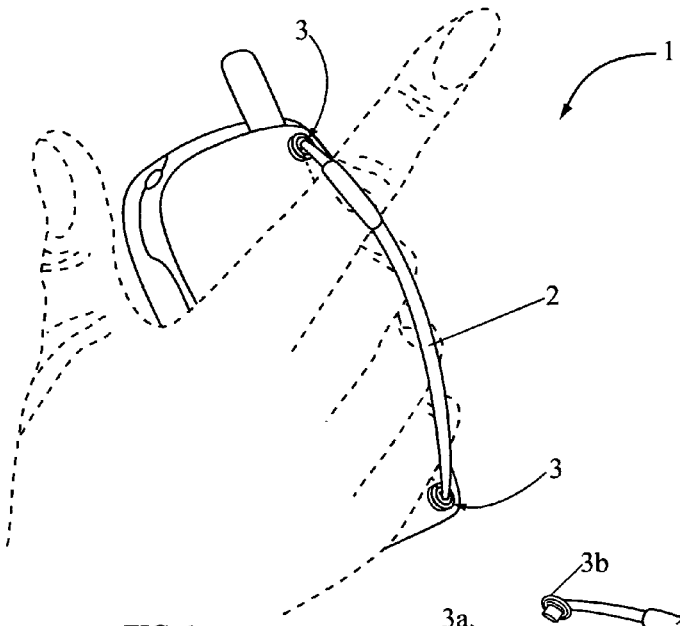
FIG. 1 illustrates a view of the securing apparatus engaged to a device and in use according to an embodiment of the present invention.
Figure 2:
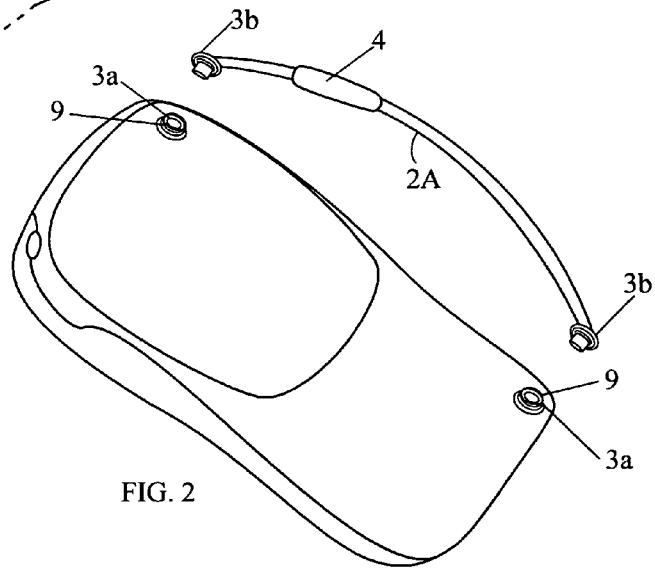
FIG. 2 illustrates a partial side view of the securing apparatus according to an embodiment of the present invention.

As shown in FIG. 1 according to an embodiment of the present invention there is a provided a securing apparatus 1 comprising a strong, flexible, elastic strip or band 2 for placement on a surface of a handheld device or object. Such handheld devices include but are not limited to electronic devices such as phones, PDA's, texting or gaming devices and may include mechanical devices as well. Such handheld devices or objects may also include handheld tools in various professions and work environments; machinery; instruments; objects used for controlling, steering or shifting; toys and other objects for all ages. The strip 2 is attachable to any device or object in which additional securing, retaining, gripping or safety function is desired when holding the device or object. The strip 2 maintains form after stretching and when not in use rests substantially flush against a surface of the device. The elastic strip 2 includes an attaching means 3 on each end of the strip 2 for removably attaching the strip 2 to the device. In an embodiment, as shown in FIG. 2, the attaching means 3 comprises two components, one component 3*a* for attaching directly to the device (the anchor 9, shown as a protrusion) and the corresponding second component 3*b* attached or made integral to the strip 2.

In another embodiment, the attaching means 3 is a single component (anchor) connected or made integral to the strip 2 and which is directly adhered to the device with an adhesive. Such adhesives are semi-permanent to allow the user to remove the attachment component(s) from the device with little or no cosmetic blemishes to the surface of the device. Adhesives of like material may include strong glues or epoxy or double sided tape. The strip 2 is comprised of any material having elastomeric properties. These elastomeric materials include but are not limited to neoprene, latex, nitrile or other rubber, silicone or polymer materials. In other embodiments, the strip 2 may comprise of a waterproof material and/or cleaning solvent proof material.

The securing apparatus stretches over the user's hand or finger due to the elasticity of the strip 2 along with the attaching means 3 so at to provide a secure grip for the user and prevent accidental dropping as well as provide additional support for users in holding the device for long periods of time. The strip 2 is sleek and thin to lay discretely along the surface of the device and provides a single opening through which the user may insert their finger(s) or hand. The single opening allows a user to easily engage with the apparatus with minimal dexterity. In an embodiment, the elastic strip 2 of the apparatus has a textured or anti-slip surface on at least the underside of the strip 2A where the strip contacts the user to provide additional gripping function.

Figure 3:
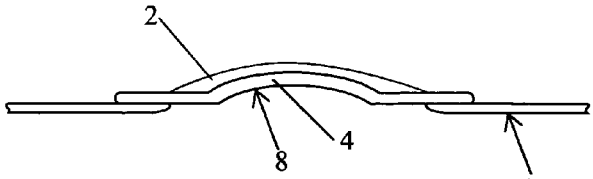
FIG. 3 illustrates the securing apparatus disengaged from a device according to an embodiment of the present invention.
Figure 4:
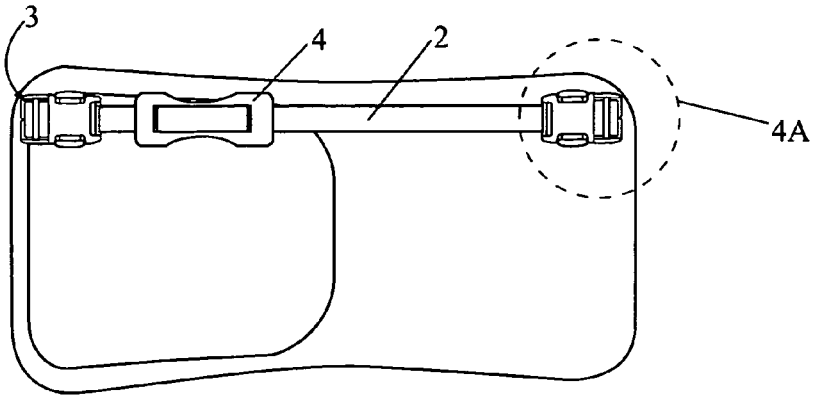
FIG. 4 illustrates the securing apparatus engaged to a device according to another embodiment of the present invention.

As illustrated, the securing apparatus may further comprise a lift mechanism 4. The lift mechanism 4 comprises a thin and discrete attachment or integrated component to the strip 2 that assists the user in placing their finger or hand between the device and the strip 2. The lift mechanism 4 may be attached to the strip 2 and made adjustable along the length of the strip 2. As shown in FIG. 3 and FIG. 4, the lift mechanism may have two apertures for engaging the strip 2 through and allowing for the lift mechanism 4 to slide along the strip 2 and can further be removable from the strip 2 if desired. In another embodiment, the lift mechanism 4 is made integral to the strip or formed as part of the strip material itself. The lift mechanism 4 may comprise a harder or softer material than the strip 2 material or alternatively be comprised of the same material as the strip 2. The lift mechanism 4 is constructed in various sizes and lengths to accommodate the user's preference in facilitating use with one or more fingers. In an alternative embodiment, the lift mechanism 4 comprises surfaces having an anti-slip property 8, such as a sticky, tacky or textured property to facilitate use, for instance by a user wearing gloves.

As shown in FIG. 3, in a side view of an embodiment, the lift mechanism 4 is structured with a curvature on one or more edge to facilitate lifting of the strip 2 and thereby providing minimal dexterity such that a user can better able to engage the strip 2 with one hand. The lift mechanism 4 may be formed in various shapes and attached or formed into the strip in various ways. The lift mechanism 4 in some embodiments is woven or otherwise attached to surround a segment of the strip 2. In some embodiments, the lift mechanism 4 is in a round shape, bead-like or tubular in form as shown in FIGS. 1-2. The lift mechanism 4 may be larger in width than the width of the strip 2, however, the overall securing apparatus is preferably no larger than the smallest width dimension of the device it is being attached so as to maintain a sleek and fashionable look. The discrete structure of the securing apparatus provides minimal interference with other objects and does not obstruct the device's compatibility with other cases, cradles, docks, car kits and other accessories.

In an embodiment as shown in FIG. 3, the attaching means 3 comprises discrete snaps providing for ease in replacing the strip 2. A first part 3*a* of each snap is attached to the device with removable adhesive and hence can be removed and cleaned without cosmetically affecting the device. A second part 3*b* of the snap is provided on each end of the strip 2 and is snapped into each first part 3*a* to securely yet removably attach the elastic strip 2 to the device.

Figure 4A:
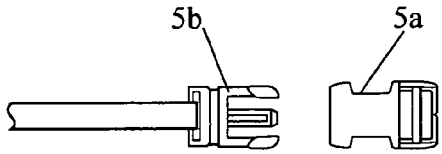
FIG. 4A illustrations the partial detail shown in FIG. 4 in a disengaged state.

In an alternate embodiment as shown in FIG. 4, the attaching means 3 comprises discrete buckle connections on each end of the strip 2 providing for ease in replacing the strip 2. The buckle connections are shown in an engaged state. As shown in the detail of FIG. 4A the partial view of the buckle connection is in a disengaged state in which an anchor 5*a* of each buckle connection is attached to the device with removable adhesive. A second part 5*b* of the buckle is provided on each end of the strip 2 and is snapped into each anchor 5*a* to securely yet removably attach the elastic strip 2 to the device. As shown in FIG. 4, the strip 2 of the securing apparatus lays closely and tautly against the surface of the device when not in use.

Figure 5:
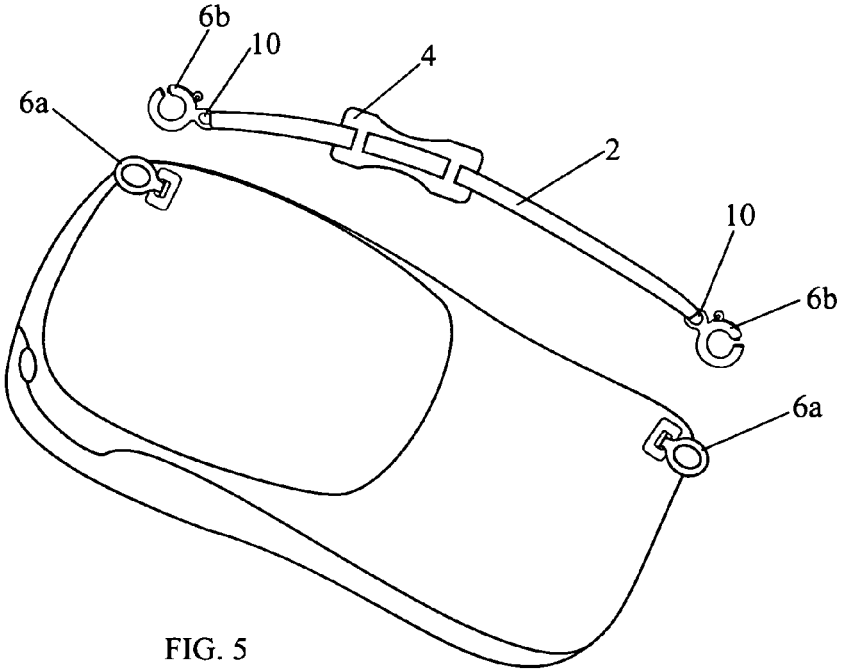
FIG. 5 illustrates the securing apparatus according to another embodiment of the present invention.

FIG. 5 illustrates another embodiment of the present invention in which the attaching means 3 comprises two small loops 6*b* provided on each end of the strip 2. An engaging part 6*a* for each loop such as a hook mechanism is attached to the device with a removable adhesive. As shown, a loop or aperture 10 is provided at each end of the strip 2 which are engaged with a corresponding receiving means, according to embodiments of the present invention.

Figure 6:
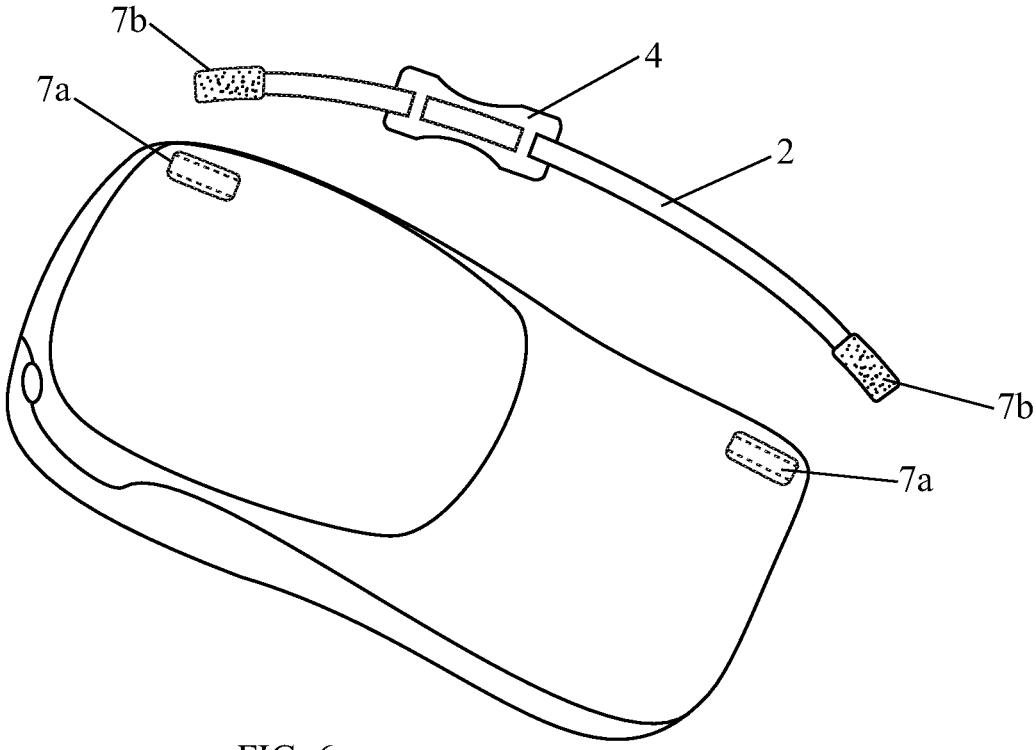
FIG. 6 illustrates the securing apparatus according to another embodiment of the present invention.

FIG. 6 illustrates another embodiment of the present invention in which the attaching means 3 comprises two small VELCRO®, also known as hook-and-loop fasteners, pieces 7*b* provided on each end of the strip 2. An engaging VELCRO® part 7*a* for each is attached to the device with a removable adhesive.

The attaching means 3 in embodiments of the present invention may be selected from a group consisting of snaps, buttons, hooks, VELCRO®, loops, buckles and adhesives for example, but are not limited therein.

Figure 7:
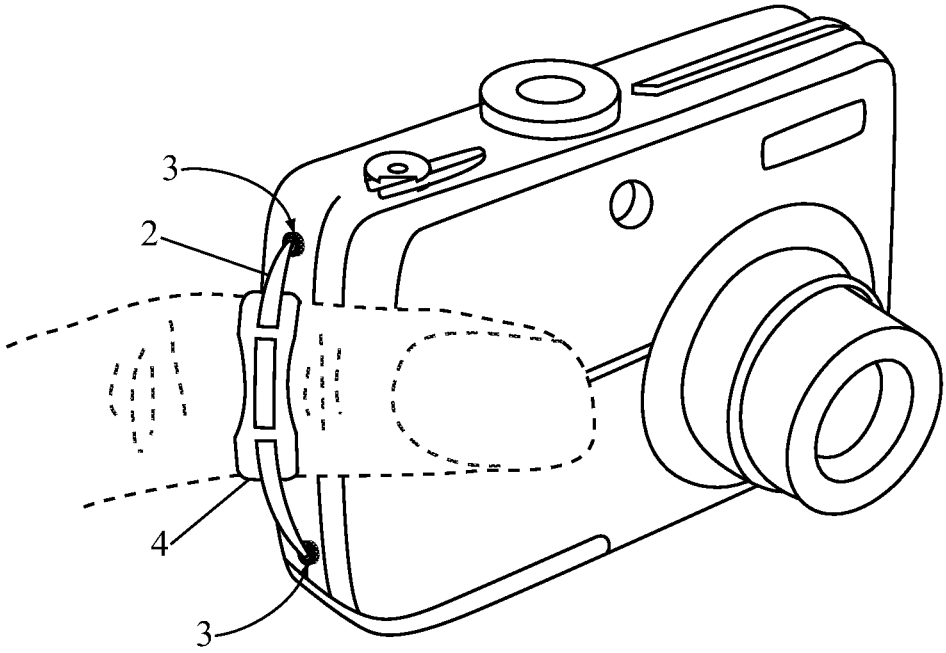
FIG. 7 illustrates the securing apparatus according to another embodiment of the present invention.

In another embodiment of the present invention as shown in FIG. 7, the securing apparatus is attached to a device in which the strip 2 is configured to accommodate the dimensions of the device. As shown, the strip 2 is configured such that the strip 2 is stretched over just a few fingers or just one finger, which allows for security in holding the device, yet maintains the aesthetic and streamlined function of the securing apparatus.

In a further embodiment of the present invention, the securing apparatus comprises a sensor attached to the strip 2, such that the sensor indicates whether the securing apparatus is separated from the user.

In all embodiments where the attaching means have two components where one component is attached to a device using removable adhesive, it is contemplated that devices may be prefabricated with latches, hooks, apertures or receiving means for corresponding with the attaching means of the present invention without requiring an adhesive. As such, the embodiments are not limited to configurations described above but may accommodate the structure of devices manufactured in the future and/or may be incorporated directly into the manufacture of such devices.

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments of the foregoing description.

What is claimed is:

1. A securing apparatus for maintaining a user's grip on a handheld device, comprising:

an elastic strip configured to rest closely against a surface of the device having a lift section on the strip, wherein the lift section is removably attached to the strip and adjustable in position along a length of the strip;

a pair of removable anchors corresponding to each end of the strip, attachable to the device, for engaging the strip at each end to said device and forming a single opening between the strip and device;

wherein the strip further comprises an aperture integrally formed at each end of the strip for engaging with the corresponding removable anchor, and wherein each of the removable anchors comprises a receiving protrusion having a width larger than a width of the aperture, such that each aperture is stretchable around a perimeter of the receiving protrusion of the corresponding anchor.

2. The securing apparatus according to claim 1, wherein the strip is configured of an anti-slip material on at least an inner side for contact with a user.

3. The securing apparatus according to claim 1, wherein the lift section comprises an anti-slip portion on a surface of the lift section.

4. The securing apparatus according to claim 1, wherein the lift section comprises a curvature on one or more edges of the lift section.

5. The securing apparatus according to claim 1, wherein the lift section includes two apertures spaced apart and the strip engages with the lift section through the two apertures.

* * * * *